US005565311A

United States Patent [19]

Kawamoto

[11] Patent Number: 5,565,311

[45] Date of Patent: Oct. 15, 1996

[54] SILVER HALIDE PHOTOGRAPHIC MATERIAL

[75] Inventor: Fumio Kawamoto, Kanagawa, Japan

[73] Assignee: Fuji Photo Film Co., Ltd., Kanagawa, Japan

[21] Appl. No.: 265,339

[22] Filed: Jun. 24, 1994

[30] Foreign Application Priority Data

Jun. 24, 1993 [JP] Japan ..... 5-153909

[51] Int. Cl.[6] ..... G03C 1/76

[52] U.S. Cl. ..... 430/523; 430/631; 430/637; 430/546; 430/527; 430/531; 430/533

[58] Field of Search ..... 430/523, 631, 430/637, 527, 531, 533, 546

[56] References Cited

U.S. PATENT DOCUMENTS 4,917,993 4/1990 Mukunoki et al. ..... 430/523
4,943,520 7/1990 Yoneyama et al. ..... 430/523
4,975,363 12/1990 Cavallo et al. ..... 430/637
5,019,491 5/1991 Takeuchi ..... 430/637
5,098,821 3/1992 Cavallo et al. ..... 430/637

*Primary Examiner*—Geraldine Letscher
*Attorney, Agent, or Firm*—Sughrue, Mion, Zinn, Macpeak & Seas

[57] ABSTRACT

A silver halide photographic material is disclosed, which comprises at least one compound represented by the following general formula (1) or (2):

$$R_1XAD \quad (1)$$
$$R_2YBZR_3 \quad (2)$$

wherein $R_1$, $R_2$ and $R_3$ each represent a $C_{25-70}$ alkyl group; X, Y and Z each represent a divalent bridging group; A and B each represent any unit selected from the group consisting of $-(CH_2CH_2O)_a-$, $-(CH_2CH(OH)CH_2O)_b-$, $-((CH_2)_cCH(R)CH_2O)_d-$, and $-(CH_2CH_2O)_e-(CH_2CH(OH)CH_2O)_f-((CH_2)_cCH(R)CH_2O)_g-$ in which c represents an integer 1 to 3 and R represents H, $CH_3$ or phenyl group; D represents a hydrogen atom or $C_{1-8}$ alkyl group; and a represents 5 to 40, b and d each represent 5 to 30, e represents 0 to 40, and f and g each represent 0 to 30.

14 Claims, No Drawings

SILVER HALIDE PHOTOGRAPHIC MATERIAL

FIELD OF THE INVENTION

The present invention relates to a silver halide photographic material comprising a support having thereon at least one photographic silver halide emulsion layer.

BACKGROUND OF THE INVENTION

In general, a photographic light-sensitive material comprises a silver halide photographic emulsion layer coated directly or via a subbing layer on either or both sides of a support such as cellulose acetate, polyethylene terephthalate, paper and paper laminated with polyethylene terephthalate on both sides thereof, and optionally an interlayer, a protective layer, a filter layer, an antistatic layer, an antihalation layer, etc. coated thereon in various combination. These layers normally comprise a hydrophilic binder such as gelatin as a constituent. An example of the photographic light-sensitive material comprising a photographic emulsion layer provided on both sides of a support is a direct X-ray film. Most photographic light-sensitive materials comprise a photographic emulsion layer provided on only one side of a support. Accordingly, the latter has an uncoated surface, i.e., a surface of the support. This is normally called "back face" of the photographic light-sensitive material in the art.

A photographic light-sensitive material is often liable to serious adverse effects produced by contact friction with the portion of various apparatus, machines and camera with which it comes in contact or contaminants such as dust and lint during production step such as coating, drying and processing or handling such as winding, rewinding and conveyance upon picture taking, development, printing, projection, etc. In particular, the back face has more opportunity to come into direct contact with various apparatus and machines and is liable to damage such as scratch, deterioration of the drivability of the light-sensitive material in camera or other machines, and generation of film dust. Such a damage as scratch appears on the image during printing or projection and thus causes serious defects in the practical use. Further, due to the recent expansion of the use or processing of photographic light-sensitive materials, e.g., high speed coating, rapid photographing and rapid processing, and the diversification of the working atmosphere as in a high humidity and temperature atmosphere, the photographic light-sensitive materials are subject to harsher usage and thus are more liable to damage and drivability drop than ever. Thus, a photographic light-sensitive material whose surface exhibits a high slipperiness and scratch resistance enough to withstand under such severe conditions has been desired.

As a method for improving the slipperiness and scratch resistance of the back face of a photographic light-sensitive material, there has heretofore been used a method which comprises providing a surface layer containing a slip agent. Known examples of such a slip agent include polyorganosiloxanes as disclosed in JP-B-53-292 (The term "JP-B" as used herein means an "examined Japanese patent publication"), higher aliphatic amides as disclosed in U.S. Pat. No. 4,275,146, higher aliphatic esters (esters of $C_{10-24}$ aliphatic acid with $C_{10-24}$ alcohol) as disclosed in JP-B-58- 33541, British Patent 927,446, JP-A-55-126238, and JP-A-58-90633 (The term "JP-A" as used herein means an "unexamined published Japanese patent application"), metallic salts of higher aliphatic acid as disclosed in U.S. Pat. No. 3,933,516, and polyester compounds made of dicarboxylic acid having up to 10 carbon atoms and aliphatic or cyclic aliphatic diol as disclosed in JP-A-51-37217.

By applying such a slip agent to the surface layer, the slipperiness and scratch resistance of the photographic light-sensitive material can be improved. However, the application of such a slip agent to a photographic light-sensitive material causes some troubles. Firstly, for example, when a silicone is applied to the back layer, it migrates to the surface of the support on which a photographic emulsion is coated, drastically deteriorating the coatability (e.g., attraction, wettability) of the support with the photographic emulsion. This causes uneven coating of emulsion. Even if the emulsion can be coated on the support, the migrated slip agent causes poor adhesion of the emulsion to the support. Thus, the migration of the slip agent to the side of the support on which the emulsion is coated (hereinafter referred to as "undercoating side") after the coating of the slip agent causes some troubles.

These troubles can be significantly solved by the use of a higher aliphatic acid and its derivatives. However, another problem is that the use of a higher aliphatic acid, higher aliphatic amide, metallic salt of higher aliphatic acid or the like causes bleeding of the slip agent during coating or with time to produce a white powder or elution or falling of the slip agent, impairing the effects of the slip agent or contaminating the processing solution.

It has been found that these troubles can be significantly solved by the use of a polyvalent alcohol ester of higher aliphatic acid, higher alcohol ester of straight-chain or branched higher aliphatic acid, higher aliphatic dicarboxylic acid, diester of diol, oligoester compound containing a higher aliphatic acid, or the like.

The surface of the back layer on the support is normally provided with a binder layer for the purpose of protecting the underlying layer or providing a matting layer or AS layer. Accordingly, the foregoing slip agent is preferably incorporated in the binder to minimize the number of layers to be coated. If the foregoing slip agent is used with a binder, it is incorporated therein in the form of solution or dispersion. In this case, if the slip agent is applied in the form of solution, some troubles occur. For example, the slip agent is not dissolved in the coating solution. Further, the slip agent diffuses into layers under the slip layer on which it is coated, or, if the support itself swells with the coating solvent, it further diffuses into lower layers, reducing the amount of the slip agent occurring in the surface and thus deteriorating the slipperiness thereof. This also requires a large amount of a slip agent. Further, if the slip agent is applied in the form of dispersion, it causes some troubles. For example, the haze of the material is increased. The slipperiness and scratch resistance of the material are deteriorated as well. The dispersion stability of the slip agent in the coating solution is not sufficient, causing the slip agent to be agglomerated or sedimented during or after coating. This makes impossible to obtain satisfactory properties.

SUMMARY OF THE INVENTION

It is therefore an object of the present invention to provide a photographic light-sensitive material which can be prepared without any troubles such as uneven coating of emulsion, poor adhesion of emulsion and bleeding during coating or with time and comprises a surface layer that exhibits little deterioration of slipperiness after development or under various working conditions.

It is another object of the present invention to provide a photographic light-sensitive material uniformly coated with a stable dispersion of a slip agent.

It is a further object of the present invention to provide a photographic light-sensitive material having a slip layer that exhibits a sufficient slipperiness and scratch resistance and reduces the number of layers to be coated despite the process which comprises the incorporation of a slip agent in a binder.

These and other objects of the present invention will become more apparent from the following detailed description and examples.

The foregoing objects of the present invention are accomplished with a silver halide photographic material, which comprises a compound represented by the following general formula (1) or (2):

$$R_1XAD \quad (1)$$

$$R_2YBZR_3 \quad (2)$$

wherein $R_1$, $R_2$ and $R_3$ each represent a $C_{25-70}$ alkyl group; X, Y and Z each represent a divalent bridging group; A and B each represent any unit selected from the group consisting of $-(CH_2CH_2O)_a-$, $-(CH_2CH(OH)CH_2O)_b-$, $-((CH_2)_cCH(R)CH_2O)_d-$, and $-(CH_2CH_2O)_e-(CH_2CH(OH)CH_2O)_f-((CH_2)_cCH(R)CH_2O)_g-$ in which c represents an integer 1 to 3 and R represents H, $CH_3$ or phenyl group; D represents a hydrogen atom or $C_{1-8}$ alkyl group; and a represents 5 to 40, b and d each represent 5 to 30, e represents 0 to 40, f and g each represent 0 to 30.

DETAILED DESCRIPTION OF THE INVENTION

The slip agent according to the present invention will be further described hereinafter. Referring to the basic structure of the compound of the present invention represented by the general formula (1) or (2), it essentially comprises i) an aliphatic hydrocarbon group moiety having a large number of carbon atoms for providing a slipperiness and scratch resistance and ii) a polyether moiety for providing a solubility and dispersion stability of the slip agent.

The aliphatic hydrocarbon moiety in the slip agent according to the present invention is $R_1$, $R_2$ or $R_3$ in the general formula (1) or (2). This aliphatic hydrocarbon group has 25 to 70 carbon atoms. This aliphatic hydrocarbon group may contain unsaturated bonds, may be substituted by various substituents (e.g., a hydroxy group, an alkyl group, a substituted or unsubstituted amine group or ammonium group, a carboxyl acid group or its salt, a halogen atom) or may contain a branched structure. Particularly preferred for slipperiness and scratch resistance is a straight-chain aliphatic hydrocarbon group. The number of carbon atoms contained in the hydrocarbon group is in the range of not less than 25 to not more than 70. If the number of carbon atoms contained in the hydrocarbon group is less than 25, it cannot provide a sufficient slipperiness and scratch resistance and gives a reduced slipperiness after processing. As a functional group single-terminated hydrocarbon compound having not more than 70 carbon atoms, there is known a long straight-chain or branched aliphatic alcohol. However, few compounds containing a hydrocarbon group having more than 70 carbon atoms are known. A particularly preferred number of carbon atoms contained in the hydrocarbon group is from not less than 30 to not more than 50.

The foregoing hydrocarbon group is connected to the polyether moiety via a divalent bridging group. Examples of the divalent bridging group represented by X or Y in the general formula (1) or (2) include —C(O)O—, —OCO—, —C(O)NR'—, —NR'CO—, —$SO_2$NR'—, —NR'$SO_2$—, —O—, —S—, —NR'—, —OCOR"COO—(e.g., —OCO-COO—, —OCO$(CH_2)_8$COO—, —OCO$C_6H_4$COO—), and —OCOR'"O— (e.g., —OCO$CH_2$O—, —OCO$(CH_2)_8$O—, —OCO$C_6H_4$O—) (in which R' represents a hydrogen atom or an alkyl group having not more than 8 carbon atoms, R" represents a $C_{0-8}$ hydrocarbon group, and R'" represents a $C_{1-8}$ hydrocarbon group). Examples of the divalent bridging group represented by Z include —C(O)—, —C(O)R"COO—, and —C(O)R'"O— (in which R" and R'" are the same as defined above). The bridging group Z may be omitted.

The polyether moiety in the slip agent according to the present invention corresponding to A or B in the general formula (1) or (2) comprises any unit selected from the group consisting of $-(CH_2CH_2O)_a-$, $-(CH_2CH(OH)CH_2O)_b-$, $-((CH_2)_cCH(R)CH_2O)_a-$, and $-(CH_2CH_2O)_e-(CH_2CH(OH)CH_2O)_f-((CH_2)_cCH(R)CH_2O)_g-$ in which a represents 5 to 40 (preferably 5 to 30), b and d each represent 5 to 30 (preferably 5 to 25), c represents an integer 1 to 3, e represents 0 to 40 (preferably 0 to 30), f and g each represent 0 to 30 (preferably 0 to 25), (e+f+g) is preferably in the range of 2 to 40 (preferably 5 to 30), and R represents H, $CH_3$ or phenyl group. If the length of such a nonionic group is too short, the slip agent cannot have a sufficient solubility or sufficient dispersion stability. On the contrary, if the length of the nonionic group is too long, the slip agent cannot exhibit a sufficient slipperiness and scratch resistance and gives a poor slipperiness with time after processing. Particularly preferred among these nonionic groups is $-(CH_2CH_2O)_a-$. With respect to a, b, d, e, f and g, their value is determined by the molecular weight distribution, it is not necessary to be an integer.

The synthesis of the polyether-containing compound employable in the present invention can be easily accomplished by successive addition reaction of a corresponding higher alcohol with ethylene oxide by an ordinary process, or dehydro-condensation of a corresponding dicarboxylic acid with the higher alcohol-polyether adduct, or condensation of the higher alcohol-polyether adduct with a higher carboxylic acid.

Specific examples of the compound represented by the general formula ( 1 ) or ( 2 ) which can be preferably used in the photographic light-sensitive material according to the present invention will be given below.

$$C_{25}H_{49}O(CH_2CH_2O)_5H \quad (I\text{-}1)$$

$$C_{30}H_{61}O(CH_2CH_2O)_{10}H \quad (I\text{-}2)$$

$$C_{30}H_{61}O(CH_2CH_2O)_{40}H \quad (I\text{-}3)$$

$$C_nH_{2n+1}O(CH_2CH_2O)_{13}H$$
(n=30–60, average carbon number 40) (I-4)

$$C_mH_{2m+1}O(CH_2CH_2O)_{16}H$$
(m=40–70, average carbon number 50) (I-5)

$$C_{30}H_{61}OC(O)CH_2CH_2COO(CH_2CH_2O)_9H \quad (I\text{-}6)$$

$$C_{27}H_{55}COO(CH_2CH_2O)_6H \quad (I\text{-}7)$$

$$C_{40}H_{81}OC(O)CH_2CH_2COO(\underset{\underset{CH_3}{|}}{C}HCH_2O)_8H \quad (I\text{-}8)$$

$$C_5H_{101}O(CH_2CH_2O)_9CH_3 \quad (I\text{-}9)$$

$$\text{iso-}C_{40}H_{81}O(CH_2CH_2O)_{10}H \quad \text{(I-10)}$$

$$\text{iso-}C_{40}H_{81}O(CH_2\underset{\underset{OH}{|}}{C}HCH_2O)_{15}H \quad \text{(I-11)}$$

$$C_{40}H_{81}OC(O)CH_2CH_2COO(\underset{\underset{CH_3}{|}}{C}HCH_2O)_6(CH_2CH_2O)_8H \quad \text{(I-12)}$$

$$C_{30}H_{61}OC(O)CH_2CH_2O(CH_2CH_2O)_{10}CH_2CH_2COOC_{30}H_{61} \quad \text{(II-1)}$$

$$C_{30}H_{61}OC(O)CH_2CH_2O(CH_2CH_2O)_{25}CH_2CH_2COOC_{30}H_{61} \quad \text{(II-2)}$$

$$C_{40}H_{81}OC(O)CH_2CH_2COO(CH_2CH_2O)_{15}C(O)CH_2CH_2\text{-}COOC_{40}H_{81} \quad \text{(II- 3)}$$

$$C_{50}H_{101}O(CH_2CH_2O)_{16}C(O)CH_2CH_2COOC_{30}H_{61} \quad \text{(I-4)}$$

$$C_{30}H_{61}O(\underset{\underset{CH_3}{|}}{C}H_2CH_2O)_6(CH_2CH_2O)_8C(O)CH_2CH_2COOC_{30}H_{61} \quad \text{(II-5)}$$

$$C_{40}H_{81}OC(O)CH_2CH_2O(CH_2\underset{\underset{OH}{|}}{C}HCH_2O)_{15}CH_2CH_2COOC_{40}H_{81} \quad \text{(II-6)}$$

The amount of the slip agent according to the present invention to be used is not specifically limited but is preferably in the range of 0.0005 to 1 g/m$^2$, more preferably 0.001 to 0.5 g/m$^2$, particularly 0.002 to 0.3 g/m$^2$.

The slip agent according to the present invention is preferably incorporated in a surface layer of the photographic light-sensitive material. This surface layer may be a surface layer constituting the emulsion layer or back face. Since the back face comes into direct contact with various apparatus and machines more often than the other surface layers, the slip agent is preferably incorporated in the back face. The layer in which the slip agent is incorporated is not specifically limited but is preferably an outermost layer.

It is desirable that the slipperiness of the back face to which the slip agent is added be satisfactory even after development. This is because that the developed photographic material is also placed under a condition that it is liable to be damaged by, e.g., transportation by a printer. If the slipperiness is satisfactory even after development, the damage due to transportation by a printer becomes less by improved scratch resistance for slip.

With respect to the slipperiness of the back layer, it is desirably to exhibit a kinetic coefficient of friction of not more than 0.25, preferably not more than 0.20, more preferably 0.15 before and after development.

The application of the slip agent according to the present invention to the support can be accomplished by coating in the form of solution in an organic solvent or coating in the form of properly diluted dispersion in an organic solvent or water. This coating solution may be coated on the back face or on the emulsion face during the coating of an emulsion, and then dried to accomplish the application of the slip agent to the support. However, the foregoing slip agent can be easily dissolved in an aromatic hydrocarbon solvent such as xylene or a nonpolar solvent such as hexane and cyclohexane but can be hardly dissolved in other solvents. These solvents having a low polarity are undesirable in the light of explosion-proofness, environmental pollution or adverse effects on human health. Further, if the slip agent is incorporated in a binder, most of the foregoing solvents cannot be used due to its capability of dissolving the binder. Therefore, if the binder is added, or if a solvent having a high polarity is used, it is particularly preferred to incorporate the slip agent in the coating solution in the form of dispersion. The foregoing slip agents can be finely and stably dispersed in either water or organic solvent in the coating solution due to its effect of nonionic group. Thus, the foregoing slip agents are particularly preferred materials in the light of dispersibility.

The dispersion of the slip agent can be accomplished by known emulsification or dispersion method. Preferred examples of such an emulsification or dispersion include aqueous emulsification in the form of solution in an organic solvent, aqueous emulsification of a slip agent molten at a high temperature, and solid dispersion by a ball mill or sandgrinder. Such an emulsification or dispersion method is further described in "Application Handbook of Emulsification and Dispersion Techniques" edited by Karigome, Koishi and Hidaka (Science Forum).

The slip agent according to the present invention may also be dispersed in an organic solvent by various means. The dispersion of the slip agent in an organic solvent can be accomplished by any known method. Preferred examples of such known methods include a process which comprises solid-dispersion of a slip agent in an organic solvent by means of a ball mill, sandgrinder or the like, a process which comprises dissolving a slip agent in an organic solvent at a high temperature, and then allowing the solution to cool with stirring so that the slip agent is deposited and dispersed therein, a process which comprises dissolving a slip agent in an organic solvent at a high temperature, and then adding the solution to a room temperature or cooled organic solvent so that it was cooled to cause the slip agent to be deposited and dispersed therein, and a process which comprises the use of organic solvents incompatible with each other to effect emulsification. Particularly preferred among these processes is the process which comprises dissolving a slip agent in an organic solvent at a high temperature, and then adding the solution to a room temperature or cooled organic solvent so that it was cooled to cause the slip agent to be deposited and dispersed therein. The organic solvent to be used in dispersion is not specifically limited. As a cooling medium to which the slip agent solution is to be added, there may be preferably used a solvent having a high polarity. Specific examples of a solvent which can be preferably used as a cooling medium include ketones, esters, and alcohols. Particularly preferred among these solvents are alcohols. Specific examples of agitator which can be preferably used in dispersion include commonly used agitators, high speed homogenizers, and ultrasonic dipersers.

Preferred examples of the solvent for use in the coating of the slip layer according to the present invention include water, water containing various surface active agents, alcohols (e.g., methanol, ethanol, isopropanol, butanol), ketones (e.g., acetone, methyl ethyl ketone, cyclohexanone), esters (e.g., methyl, ethyl, propyl and butylester of acetic acid, formic acid, oxalic acid, maleic acid and succinic acid), hydrocarbons (e.g., hexane, cyclohexane), halogenated hydrocarbons (e.g., methylene chloride, chloroform, carbon tetrachloride), aromatic hydrocarbons (e.g., benzene, toluene, xylene, benzyl alcohol, benzoic acid, anisole), amides (e.g., dimethylformamide, dimethylacetamide, n-methylpyrrolidone), ethers (e.g., diethyl ether, dioxane, tetrahydrofurane), ether alcohols such as propyleneglycol monomethyl ether, glycerin, diethylene glycol, and dimethyl sulfoxide. These solvents may be used in admixture.

When the foregoing slip agent is applied to the surface layer, it is preferably used with a film-forming binder. As such a polymer, there may be used a known thermoplastic resin, thermosetting resin, radiation-curing resin, reactive resin, mixture thereof, hydrophilic binder such as gelatin, or the like.

Specific examples of the foregoing thermoplastic resin include cellulose derivatives such as cellulose triacetate, cellulose diacetate, cellulose acetate malate, cellulose acetate phthalate, hydroxyacetyl cellulose phthalate, long chain alkylester of cellulose, nitrocellulose, cellulose acetate propionate and cellulose acetate butyrate resin, vinyl copolymers such as vinyl chloride-vinyl acetate copolymer, copolymer of vinyl chloride or vinyl acetate with vinyl alcohol, maleic acid and/or acrylic acid, vinyl chloride-vinylidene chloride copolymer, vinyl chloride-acrylonitrile copolymer and ethylene-vinyl acetate copolymer, rubber resins such as acrylic resin, polyvinyl acetal resin, polyvinyl butyral resin, polyester polyurethane resin, polyether polyurethane resin, polycarbonate polyurethane resin, polyester resin, polyether resin, polyamide resin, amino resin, styrenebutadiene resin and butadiene acrylonitrile resin, silicone resins, and fluorinic resins.

As the foregoing radiation-curing resin, there can be used the foregoing thermoplastic resin to which unsaturated carbon-carbon bonds are bonded as radiation-curing functional groups. Preferred examples of such functional groups include acryloyl group, and methacryloyl group.

In the foregoing bonding molecules may be incorporated a polar group (e.g., epoxy group, $CO_2M$, OH, $NR_2$, $NR_3X$, $SO_3M$, $OSO_3M$, $PO_3M_2$, $OPO_3M_2$ in which M represents a hydrogen atom, alkaline metal or ammonium and R represents a hydrogen atom or alkyl group, with the proviso that when there are a plurality of M's, they may be the same or different).

The foregoing high molecular binding agents may be used singly or in admixture. These binding agents can be cured by the addition of a known isocyanate crosslinking agent and/or radiation-curing vinyl monomer.

As hydrophilic binders there have been disclosed water-soluble polymers, cellulose esters, latex polymers, water-soluble polyesters, etc. in *Research Disclosure* Nos. 17643, page 26, and 18716, page 651. Examples of such water-soluble polymers include gelatin, gelatin derivatives, casein, agar, sodium alginate, starch, polyvinyl alcohol, polyacrylic acid copolymer, and maleic anhydride copolymer. Examples of the foregoing cellulose esters include carboxymethyl cellulose, and hydroxyethyl cellulose. Examples of the latex polymers include vinyl chloride-containing copolymers, anhydrous vinylidene-containing copolymers, acrylic ester-containing copolymers, vinyl acetate-containing copolymers, and butadiene-containing copolymers. The most preferred among these hydrophilic binders is gelatin. Gelatin may be used in combination with gelatin derivatives.

The protective layer containing the foregoing hydrophilic binder may be hardened. Examples of hardeners include aldehyde compounds such as formaldehyde and glutaraldehyde, ketone compounds such as diacetyl and cyclopentanedione, bis(2-chloroethylurea), 2-hydroxy-4,6 -dichloro-1,3,5-triazine, other reactive halogen-containing compounds, divinylsulfone, 5-acetyl-1,3-diacryloylhexahydro- 1,3,5-triazine, reactive olefin-containing compounds, N-hydroxymethyl phthalimide, N-methylol compounds, isocyanates, aziridine compounds, acid derivatives, epoxy compounds, and halogen carboxyaldehydes such as mucochloric acid. Examples of inorganic hardeners include chromium alum, and zirconium sulfate. Further, carboxyl active hardeners can be used.

Among the foregoing binders, hydrophobic binders can hardly cause blocking the back face with the emulsion surface and thus are particularly desirable.

The antistatic agent to be incorporated in the photographic light-sensitive material according to the present invention will be further described hereinafter.

The antistatic agent employable in the present invention is not specifically limited. For example, as an anionic high molecular electrolyte, there may be used an electrolyte containing a carboxylic acid, carboxylate or sulfonate. Examples of such an electrolyte include high molecular compounds as disclosed in JP-A-48-22017, JP-B-46- 24159, JP-A-51-30725, JP-A-51-129216, and JP-A-55-95942. Examples of cationic high molecular compounds include those disclosed in JP-A-49-121523, JP-A-48-91165, and JP-B-49- 24582.

As an antistatic agent which doesn't lose its electric conductivity even when processed there may be preferably used at least one crystalline metal oxide selected from ZnO, $TiO_3$, $SnO_2$, $Al_2O_3$, $In_2O_3$, $SiO_2$, MgO, BaO, $MoO_3$ and $V_2O_5$ or composite thereof in the form of fine grains. A particularly preferred example of such an antistatic agent is an electrically conductive material comprising $SnO_2$ as a main component, antimony oxide in an amount of about 5 to 20% and/or other components (e.g., silicon oxide, boron, phosphorus). The electrically conductive crystalline oxide or composite thereof in the form of fine grains exhibits a specific volume resistivity of not more than $10^7$ Ω·cm, preferably not more than $10^5$ Ω·cm. The electrically conductive material in the form of fine grains has a grain size of 0.002 to 0.7 μm, preferably 0.005 to 0.3 μm.

The foregoing antistatic agent may be incorporated in at least one layer constituting the photographic layer, e.g., undercoating layer on the back side, part of the backing layer (including an outermost layer in the backing layer), undercoating layer on the emulsion side, part of the emulsion layer, interlayer, outermost layer on the emulsion side. The binder to be used in this process is not specifically limited. It may be a water-soluble binder or organic solvent-soluble binder. Alternatively, it may be crosslinked as latex.

The electrical resistance of the photographic material to which the antistatic agent mentioned above is added, is desirably not more than $10^{12}$ Ω, preferably not more than $10^{11}$ Ω, more preferably not more than $10^{10}$ Ω at 25° C. and 10% RH. If the electrical resistance is more than the above value, there is a problem that dust is liable be attached to a photographic material (film) in handling. Also, there is a problem that fogging is liable to be generated by spark due to static electricity when transported in camera.

The incorporation of a matting agent in the backing layer according to the present invention is preferred in the light of prevention of backlash or scratch during the handling of base, blocking of the undercoating surface of the base with the back face or blocking of the emulsion surface with the back face. The matting agent employable in the present invention is not specifically limited but may be an inorganic compound or a high molecular compound having a glass transition temperature Tg of not lower than 50° C. Two or more of these matting agents may be used in admixture.

Examples of an inorganic compound which can be used as such a matting agent include fine grains of inorganic compounds such as barium sulfate, manganese colloid, titanium dioxide, strontium barium sulfate and silicon dioxide, in addition, silicon dioxide such as synthetic silica obtained by wet process or gelation of silicic acid, and titanium dioxide (rutile type or anatase type) produced by the reaction of titanium slug with sulfuric acid. Such a matting agent can also be obtained by grinding inorganic compound grains having a grain diameter as relatively large as not less than 20 μm, and then classifying the grains (vibrating filtration, air classification, etc.).

Examples of the foregoing high molecular compounds include polytetrafluoroethylene, cellulose acetate, polystyrene, polymethyl methacrylate, polyporpyl methacrylate, polymethyl acrylate, polyethylene carbonate, and starch. A matting agent obtained by grinding and classifying these high molecular compounds can be also used. Alternatively, a matting agent obtained by finely dividing a high molecular compound as a polymer of one or more monomers such as acrylic ester, methacrylic ester, itaconic diester, crotonic ester, maleic diester, phthalic diester, styrene derivatives, vinylesters, acrylamides, vinylethers, allyl compounds, vinylketones, vinyl heterocyclic compounds, acrylonitrile, methacrylonitrile and multifunctional monomers by various methods such as suspension polymerization, spray drying and dispersion may be used.

The grain diameter of these matting agents is in the range of $10^{-3}$ to $10^{2}$ μm, preferably $10^{-1}$ to 10 μm, more preferably 0.5 to 5 μm. The content of the matting agent is in the range of 0.1 to $10^{3}$ mg/m$^2$, preferably 5 to 300 mg/m$^2$, more preferably 20 to 250 mg/m$^2$.

The application of the matting agent may be preferably accomplished with the use of a film-forming binder as used in the foregoing slip layer. The matting agent is preferably applied so that the surface of the back face is provided with roughness. The matting agent is preferably applied to an outermost layer in the back face or onto the matting layer in such an arrangement that a slip layer is applied without any binder. Further, this matting agent is preferably incorporated in the foregoing slip layer.

The backing layer of the present invention may further comprise a dye, a surface active agent, etc. incorporated therein.

The support employable in the present invention will be described hereinafter.

The film support employable in the present invention is not specifically limited but may be any type of plastic film. Preferred examples include cellulose derivatives (e.g., diacetyl acetate, triacetyl acetate, propionyl acetate, butanoyl acetate, acetylpropionyl acetate), polyamides, polycarbonates as disclosed in U.S. Pat. No. 3,023,101, polyesters (particularly polyethylene terephthalate, poly-1, 4-cyclohexanedimethylene terephthalate, polyethylene-1,2-diphenoxyethane-4,4'-dicarboxylate, polybutylene terepthalate, polyethylene naphthalate) as disclosed in JP-B-48-40414, polystyrenes, polypropylenes, polyethylenes, polymethylpentenes, polysulfones, polyethersulfones, polyacrylates, and polyetherimides. More preferred among these compounds are polyesters such as triacetyl cellulose, polyethylene terephthalate, and polyethylene naphthalate.

Among these supports, polyester films may be subjected to heat treatment at a temperature 5° C. to 30° C. lower than the glass transition point thereof as disclosed in JP-A-51-16358, a treatment as disclosed in JP-A-1-131550, i.e., a treatment which comprises making a temperature gradient on the surface and the opposite surface of a film between a longitudinal orientation and a successive biaxial orientation to make a difference in crystallizability and orientability that gives a permanent curling, and then winding the finished product against the permanent curling so that it is offset by the curling given with time during storage, or a treatment which comprises subjecting a polyester film thus oriented with a temperature difference to heat treatment at a temperature of not lower than 50° C. to not higher than the glass transition temperature thereof, to reduce the curling.

Among these supports as discussed above, the most preferred support is a support which contains a polyethylene naphthalate (PEN) as a main component which has been subjected to heat treatment at a temperature of not lower than 50° C. to not higher than the glass transition point (Tg) of the polyester support for 0.1 to 1,500 hours between after the film formation and before the coating of a photographic layer. The PEN may be a copolymer, a polymer blend, and a laminate or a mixed product thereof. The support containing PEN as a main component means that the constitutional element of PEN, i.e., naphthalene dicarboxylic acid, especially 2,6-naphthalene dicarboxylic acid occupies 50 mol % or more, preferably 75 mol % or more, more preferably 85 mol % in the total dicarboxylic acid. PEN is comprised of a naphthalene dicarboxylic acid and an ethylene glycol, in which the carboxylic acid is preferably naphthalene-2,6-dicarboxylic acid, 2,7-naphthalene dicarboxylic acid, 1,5-naphthalene dicarboxylic acid, with the naphthalene-2,6-dicarboxylic acid being more preferred. PEN is polymerized in the presence of a catalyst under an appropriate reaction condition. At this time, suitable one or two or more third components may be mixed therewith. Details of the support containing PEN as a main component are described, for example, in Kokai Giho (Japanese Published Technical Report) No. 94-6023, in particular, pages 3–4 and 13, and references cited therein.

Such a support may comprise a plasticizer incorporated therein to gain flexibility before use. In particular, cellulose esters may normally comprise a plasticizer such as triphenyl phosphate, biphenyl diphenyl phosphate and dimethylethyl phosphate incorporated therein.

The support according to the present invention may range from a thin film having a thickness of about 20 μm to a sheet having a thickness of about 1 mm, though depending on the kind of polymer. The commonly used thickness is in the range of 50 μm to 300 μm.

The molecular weight of such a support polymer is preferably not less than 10,000, more preferably from 20,000 to 80,000.

The support may contain a dye for the purpose of neutralization to the base tint, prevention of light piping, antihalation, etc.

In order to rigidly bond a photographic layer (e.g., photographic silver halide emulsion layer, interlayer, filter layer, magnetic recording layer, electrically conductive layer) to such a support, the support may be subjected to a surface treatment such as chemical treatment, mechanical treatment, corona discharge, flame treatment, ultraviolet treatment, high frequency treatment, glow discharge, active plasma treatment, laser treatment, mixed acid treatment and ozone oxidation, and then coated with a photographic emulsion to gain a desired adhesiveness. Alternatively, the support may be coated with an undercoating layer free of surface treatment, and then coated with a photographic emulsion layer.

The cellulose derivative may be coated singly with a gelatin dispersion in a mixture of methylene chloride, ketone and alcohol as an organic solvent to have an undercoating layer thereon.

The polyester support may be subjected to a so-called multi-layer process which comprises providing a layer adhesive to the support (hereinafter referred to as "1st undercoating layer") as a 1st layer, and then coating the 1st layer with a hydrophilic resin layer adhesive to photographic layer (hereinafter referred to as "2nd undercoating layer") as a 2nd layer or a single-layer process which comprises coating with a single resin layer containing both hydrophobic and hydrophilic groups.

The 1st undercoating layer in the multi-layer process may comprise a copolymer made of a monomer selected from the group consisting of vinyl chloride, vinylidene chloride, butadiene, methacrylic acid, acrylic acid, itaconic acid and maleic anhydride as a starting material as well as a polymer such as polyethyleneimine, epoxy resin, grafted gelatin and nitrocellulose incorporated therein. The 2nd undercoating layer is mainly composed of gelatin.

In the single-layer process, the support is often allowed to swell before being mixed with a hydrophilic undercoating polymer at the interface thereof to attain a good adhesiveness. Examples of hydrophilic undercoating polymers employable in the present invention include water-soluble polymers such as gelatin, gelatin derivative, casein, agar, sodium alginate, starch, polyvinyl alcohol, polyacrylic copolymer and maleic anhydride copolymer, cellulose esters such as carboxymethyl cellulose and hydroxyethyl cellulose, and latex polymers such as vinyl chloride-containing copolymer, vinylidene chloride-containing copolymer, acrylic ester-containing copolymer and vinyl acetate-containing copolymer. Preferred among these hydrophilic undercoating polymers is gelatin.

Examples of the compound with which the support according to the present invention swells include resorcinol, chlororesorcinol, o-cresol, m-cresol, p-cresol, phenol, o-chlorophenol, p-chlorophenol, dichlorophenol, trichlorophenol, monochloroacetic acid, dichloroacetic acid, trifluoroacetic acid, and chloral hydrate. Preferred among these compounds are resorcinol and p-chlorophenol.

The foregoing hydrophilic undercoating polymer may comprise the previously mentioned hydrophilic polymer hardener incorporated therein as a hardener.

The undercoating solution may comprise various additives incorporated therein as necessary. Examples of such additives include surface active agent, antistatic agent, antihalation agent, coloring dye, pigment, coating aid, and fog inhibitor.

The undercoating layer according to the present invention may comprise fine grains of an inorganic substance such as $SiO_2$ and $TiO_2$ or fine grains of a polymethyl methacrylate copolymer (1 to 10 μm) as a matting agent.

The coating of the undercoating solution according to the present invention can be accomplished by a commonly known coating method such as dip coating, air knife coating, curtain coating, roller coating, wire bar coating, gravure coating and extrusion coating employing a hopper as disclosed in U.S. Pat. Nos. 2,681,294. If necessary, a method as disclosed in U.S. Pat. Nos. 2,761,791, 3,508,947, 2,941,898, and 3,526,528, and Yuji Harasaki, "Coating Engineering", Asakura Shoten, page 253 (1973) may be used to effect simultaneous coating of two or more layers.

The silver halide photographic layer according to the present invention will be further described hereinafter.

The photographic light-sensitive material according to the present invention comprises a silver halide emulsion layer, a backing layer, a protective layer, an interlayer, an antihalation layer, etc. These layers may be mainly used in the form of hydrophilic colloidal layer.

Examples of the binder to be used in the hydrophilic colloidal layer include proteins such as gelatin, colloidal albumin and casein, cellulose compounds such as carboxymethyl cellulose and hydroxyethyl cellulose, sugar derivatives such as agar, sodium alginate and starch derivative, synthetic hydrophilic colloids such as polyvinyl alcohol, poly-N-vinylpyrrolidone, polyacrylic acid copolymer, polyacrylamide, derivative thereof and partial hydrolyzate thereof, dextran, polyvinyl acetate, polyacrylic ester, and rosin. If necessary, two or more of these colloids can be used in admixture.

The most commonly used among these binders are gelatin and gelatin derivatives. The term "gelatin" as used herein means a so-called lime-treated gelatin, acid-treated gelatin or enzyme-treated gelatin.

In the present invention, an anionic, nonionic, cationic or betainic fluorine-containing surface active agent may be used in combination with other additives.

These fluorine-containing surface active agents are disclosed in JP-A-49-10722, British Patent 1,330,356, JP-A-53-84712, JP-A-54-14224, JP-A-50-113221, U.S. Pat. Nos. 4,335,201, 4,347,308, British Patent 1,417,915, JP-B-52-26687, JP-B-57-26719, JP-B-59-38573, JP-A-55-149938, JP-A-54- 48520, JP-A-54-14224, JP-A-58-200235, JP-A-57-146248, JP-A- 58-196544, and British Patent 1,439,402. Specific examples of these fluorine-containing surface active agents will be given below.

$C_8F_{17}SO_3K$ F-1

$C_7F_{15}COONa$ F-2

$C_8F_{17}SO_2N(C_3H_7)-CH_2COOK$ F-3

$C_8F_{17}SO_2N(C_3H_7)(CH_2CH(OH)CH_2O)_3(CH_2)_4SO_3Na$ F-4

$C_8F_{17}SO_2N(C_3H_7)(CH_2CH_2O)_4(CH_2)_4SO_3Na$ F-5

$C_8F_{17}SO_2N(C_3H_7)CH_2CH_2O-P(=O)(ONa)-ONa$ F-6

$C_8F_{17}CH_2CH_2OOC-CH_2$
$C_8H_{17}OOC-CH-SO_3Na$ F-7

$C_8F_{17}SO_2N(H)CH_2CH_2CH_2(OCH_2CH_2)_3\overset{(+)}{N}(CH_3)_2-CH_2COO^{(-)}$ F-8

$C_8F_{17}SO_2N(H)CH_2\overset{(+)}{N}(CH_3)_2-CH_3I^{(-)}$ F-9

$C_8F_{17}SO_2N(H)CH_2CH_2(OCH_2CH_2)_3\overset{(+)}{N}(CH_3)_2-CH_3CH_3-C_6H_5-SO_3^{(-)}$ F-10

$C_8F_{17}SO_2N(C_{10}H_{21})(CH_2CH_2O)_{16}H$ F-11

In the present invention, a nonionic surface active agent may be used.

Specific examples of nonionic surface active agents which can be preferably used in the present invention will be given below.

$C_{11}H_{23}COO(CH_2CH_2O)_8H$ N-1

$C_{17}H_{33}COO(CH_2CH_2)_5(CH_2-CH(OH)-CH_2)_3(CH_2CH_2O)_5H$ N-2

$C_{16}H_{33}O(CH_2CH_2O)_{12}H$ N-3

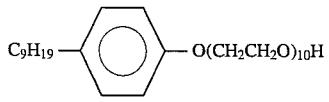

N-4

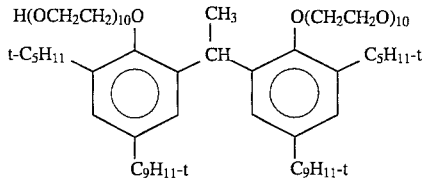

N-5

The layer in which the fluorine-containing surface active agent and nonionic surface active agent according to the present invention are incorporated is not specifically limited so far as it is at least one layer constituting the photographic light-sensitive material. For example, it may be a surface protective layer, emulsion layer, interlayer, undercoating layer, backing layer or the like.

The amount of the fluorine-containing surface active agent and nonionic surface active agent according to the present invention may be in the range of 0.0001 g to 1 g, preferably 0.0005 g to 0.5 g, particularly 0.0005 g to 0.2 g per $m^2$ of photographic light-sensitive material. Two or more of these surface active agents according to the present invention may be used in admixture.

Further, a polyol compound as disclosed in JP-A-54-89626 such as ethylene glycol, propylene glycol and 1,1,1-trimethylol propane may be incorporated in the protective layer of the present invention or other layers.

The photographic constituent layers of the present invention may comprise other known surface active agents incorporated therein singly or in admixture. These surface active agents are used as coating aids but may be sometimes used for other purposes such as emulsion dispersion, sensitization and improvement in other photographic properties.

In the present invention, a lubricating composition such as modified silicone as disclosed in U.S. Pat. Nos. 3,079,837, 3,080,317, 3,545,970, and 3,294,537, and JP-A-52- 129520 may be incorporated in the photographic constituent layers. These modified silicones are also disclosed in U.S. Pat. Nos. 4,275,146, and 3,933,516, JP-B-58-33541, British Patent 927,446, and JP-A-55-126238, and JP-A-58-90633. These compounds may be used in combination with the slip agents according to the present invention.

The photographic light-sensitive material according to the present invention may comprise a polymer latex as disclosed in U.S. Pat. Nos. 3,411,911, and 3,411,912, and JP-B-45-5331 incorporated in the photographic constituent layers.

In the photographic light-sensitive material according to the present invention, the silver halide emulsion layer and other hydrophilic colloidal layers may be hardened by various organic or inorganic hardeners (singly or in combination).

Typical examples of the silver halide color photographic material to which the present invention can be preferably applied include color reversal film and color negative film. In particular, general purpose color negative films are preferred.

The present invention will be further described with reference to general purpose color negative films.

The present photographic light-sensitive material can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the present silver halide photographic material comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light and red light. In the multi-layer silver halide color photographic material, these unit light-sensitive layers are normally arranged in the order of red-sensitive layer, green-sensitive layer and blue-sensitive layer as viewed from the support. However, the order of arrangement can be optionally reversed depending on the purpose of application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59- 113438, JP-A-59-113440, JP-A-61-20037 and JP-A-61-20038. These interlayers can further comprise a color stain inhibitor as commonly used.

The plurality of silver halide emulsion layers constituting each unit light-sensitive layer are described in West German Patent 1,121,470, British Patent 923,045, JP-A- 57-112751, JP-A-62-200350, JP-A-62-206541, JP-A-62-206543, JP-A-56-25738, JP-A-62-63936, JP-A-59-202464, JP-B-55-34932, and JP-A-49-15495.

Silver halide grains in the present invention may be so-called regular grains having a regular crystal form, such as cube, octahedron and tetradecahedron, or those having an irregular crystal form such as sphere and tablet, those having a crystal defect such as twinning plane, or those having a combination of these crystal forms.

The silver halide grains may be either fine grains of about 0.2 μm or smaller in diameter or giant grains having a projected area diameter or up to about 10 μm. The emulsion may be either a monodisperse emulsion or a polydisperse emulsion.

The preparation of the silver halide photographic emulsion which can be used in the present invention can be accomplished by any suitable method as described in *Research Disclosure* No. 17643 (December 1978), pp. 22–23, "I. Emulsion Preparation and Types", No. 18716 (November 1979), page 648, Glafkides, "Chimie et Physique Photographique", Paul Montel (1967), G. F. Duffin, "Photographic Emulsion Chemistry", Focal Press (1966) and V. L. Zelikman et al., "Making and Coating Photographic Emulsion Focal Press", (1964).

Furthermore, monodisperse emulsions as described in U.S. Pat. Nos. 3,574,628 and 3,655,394, and British Patent 1,413,748 can be preferably used in the present invention.

Tabular grains having an aspect ratio of about 5 or more can be used in the present invention. The preparation of such tabular grains can be easily accomplished by any suitable method as described in Gutoff, "Photographic Science and Engineering", vol. 14, pp. 248–257, (1970), U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have fused thereto a silver halide having a different halogen composition or a compound other than silver halide, e.g., silver thiocyanate, lead oxide, etc. by an epitaxial junction.

Mixtures of grains having various crystal forms may also be used.

The silver halide emulsion to be used in the present invention is normally subjected to physical ripening, chemical ripening and spectral sensitization. The effects of the present invention can be exerted markedly when an emulsion sensitized with a gold compound and a sulfur-containing compound is used. Additives to be used in these steps are described in *Research Disclosure* Nos. 17643 and 18716 as tabulated below.

Known photographic additives which can be used in the present invention are also described in the above cited two Research Disclosures as tabulated below.

| | Kind of additive | RD17643 | RD18716 |
|---|---|---|---|
| 1. | Chemical sensitizer | p. 23 | p. 648 right column (RC) |
| 2. | Sensitivity increasing agent | | p. 648 right column (RC) |
| 3. | Spectral sensitizer and supersensitizer | pp.23–24 | p.648 RC–p.649 RC |
| 4. | Brightening agent | p. 24 | |
| 5. | Antifoggant and stabilizer | pp. 24–25 | p. 649 RC |
| 6. | Light absorbent, filter dye, and ultraviolet absorbent | pp. 25–26 | p.649 RC–p.650 RC |
| 7. | Stain inhibitor | p. 25 RC | p.650 LC-RC |
| 8. | Dye image stabilizer | p.25 | |
| 9. | Hardening agent | p. 26 | p. 651 LC |
| 10. | Binder | p. 26 | " |
| 11. | Plasticizer and lubricant | p. 27 | p. 650 LC |
| 12. | Coating aid and surface active | pp. 26–27 | " |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

The light-sensitive material to be processed in the present invention can comprise various color couplers. Specific examples of the color couplers are described in the patents described in the above cited *Research Disclosure* No. 17643, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent 73,636, JP-A-60-33552, JP-A-60- 43659, JP-A-61-72238, JP-A-60-35730, JP-A-55-118034, and JP-A-60-185951, RD Nos. 24220 (June 1984) and 24230 (June 1984), and W088/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Application (OLS) No. 3,329,729, European Patents 121,365A and 249,453A, and JP-A-61-42658

Colored couplers for correction of unnecessary absorptions of the developed dye preferably include those described in *Research Disclosure* No. 17643, VII-G, U.S. Pat. Nos. 4,163,670, 4,004,929, and 4,138,258, JP-B-57-39413, and British Patent 1,146,368.

Couplers which form a dye having moderate diffusibility preferably include those described in U.S. Pat. Nos. 4,366,237, British Patent 2,125,570, European Patent 96,570, and West German Patent Application (OLS) No. 3,234,533.

Typical examples of polymerized dye-forming couplers are described in U.S. Pat. Nos. 3,451,820, 4,080,211, 4,367,282, 4,409,320, and 4,576,910, and British Patent 2,102,173.

Couplers capable of releasing a photographically useful residue upon coupling can also be used in the present invention. Preferred examples of DIR couplers which release a development inhibitor are described in the patents cited in RD 17643, VII-F, JP-A-57-151944, JP-A-57-154234, JP-A-60- 184248, JP-A-63-37346, and U.S. Pat. No. 4,248,962.

Couplers capable of imagewise releasing a nucleating agent or a developing accelerator at the time of development preferably include those described in British Patents 2,097,140 and 2,131,188, and JP-A-59-157638 and JP-A-59-170840.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compounds or DIR couplers or DIR coupler-releasing couplers as described in JP-A-60-185950 and JP-A-62-24252, couplers capable of releasing a dye which returns to its original color after release as described in European Patent 173,302A, bleach accelerator-releasing couplers as described in RD Nos. 11449 and 24241, couplers capable of releasing a ligand as described in U.S. Pat. No. 4,553,477, and couplers capable of releasing a leuco dye as described in JP-A-63-75747.

The incorporation of the couplers of the present invention in the light-sensitive material can be accomplished by any suitable known dispersion method.

Examples of high boiling solvents to be used in the oil-in-water dispersion process are described in U.S. Pat. No. 2,322,027.

Specific examples of high boiling organic solvents having a boiling point of 175° C. or higher at normal pressure which can be used in the oil-in-water dispersion process include phthalic esters, phosphoric or phosphonic esters, benzoic esters, amides, alcohols or phenols, aliphatic carboxylic esters, aniline derivatives, and hydrocarbons. As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of latex dispersion method and specific examples of latexes to be used in dipping are described in U.S. Pat. No. 4,199,363, West German Patent Application (OLS) 2,541,274, and 2,541,230.

In the present light-sensitive material, the total thickness of all hydrophilic colloidal layers on the emulsion side is preferably in the range of 28 μm or less. The film swelling T½ is preferably in the range of 30 seconds or less. In the present invention, the film thickness is determined after being stored at a temperature of 25° C. and a relative humidity of 55% for 2 days. The film swelling T½ can be determined by a method known in the art, e.g., by means of a swellometer of the type as described in A. Green et al., "Photographic Science and Engineering", vol. 19, No. 2, pp. 124–129. T½ is defined as the time taken until half the saturated film thickness is reached wherein the saturated film thickness is 90% of the maximum swollen film thickness reached when the light-sensitive material is processed with a color developer at a temperature of 30° C. over 195 seconds.

The film swelling T½ can be adjusted by adding a film hardener to gelatin as binder or altering the ageing condition after coating. The percentage swelling of the light-sensitive material is preferably in the range of 150 to 400%. The percentage swelling can be calculated from the maximum swollen film thickness determined as described above in accordance with the equation: (maximum swollen film thickness–film thickness)/film thickness.

The color photographic light-sensitive material according to the present invention may be subjected to development by an ordinary method as described in RD Nos. 17643, pp. 28–29, and 18716, left column to right column, page 615.

The silver halide color light-sensitive material of the present invention may contain a color developing agent for the purpose of simplifying and expediting processing. Such a color developing agent is preferably used in the form of various precursors. Examples of such precursors include indoaniline compounds as described in U.S. Pat. No. 3,342,597, Schiff's base type compounds as described in U.S. Pat. No. 3,342,599, and *Research Disclosure* Nos. 14,850 and 15,159, and compounds as described in *Research Disclosure* No. 13,924.

The present invention will be further described in the following examples, but the present invention should not be construed as being limited thereto.

EXAMPLE 1

1-1: Preparation of Support

Onto a cellulose acetate film (support) was coated the following antistatic layer coating composition A in an amount of 15 ml/m$^2$. The material was then dried at a temperature of 70° C. for 3 minutes to form an antistatic layer. (Cation polymer content in the antistatic layer: 50 mg/m$^2$)

| Antistatic Layer Coating Composition A | |
|---|---|
| (Cationic polymer) | 3.5 g |
| 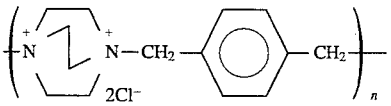 | |
| Ethylene glycol | 27 ml |
| Methanol | 600 ml |
| Acetone | 400 ml |

The foregoing polymer exhibited $\eta_{sp/c}$ (viscosity number) of 0.12 as determined at a temperature of 30° C. in the form of 0.1 wt % solution in a 1 wt % aqueous sodium chloride solution.

Onto the foregoing antistatic layer was coated the following surface protective layer coating composition A in an amount of 25 ml/m$^2$. The material was then dried at a temperature of 100° C. for 3 minutes to form an auxiliary layer (binder layer).

| Surface Protective Layer Coating Composition A | |
|---|---|
| Acetone | 850 ml |
| Methanol | 150 ml |
| Diacetyl cellulose | 6 g |
| Fine grains of $SiO_2$ (average grain diameter: 0.1 μm) | 0.7 g |

Onto the foregoing surface protective layer was coated the slip agent shown in Table 1 among the foregoing specific examples of slip agents in the form of the following slip layer coating composition A in an amount of 10 ml/m$^2$. The material was then dried at a temperature of 100 ° C. for 3 minutes to form a surface layer. Thus, specimens were prepared.

| Slip Layer Coating Composition A | |
|---|---|
| Slip agent according to the present invention | 0.2 g |
| Xylene | 1,000 ml |

The solubility of the slip agent in the coating solution was visually evaluated. The solubility was observed by determining the presence of deposits. The results are set forth in Table 1.

COMPARATIVE EXAMPLE a

Comparative Specimens a-1 to a-6 were prepared in the same manner as in Example 1 except that the inventive slip agent was replaced by the comparative slip agent set forth in Table 1.

TABLE 1

| | | | Slip Characteristics | | | |
|---|---|---|---|---|---|---|
| | | | | Kinematic friction coefficient | | |
| Specimen No. | Type of slip agent (solid content mg/m$^2$) | Slip agent solubility (deposit) | Static friction coefficient | Before development | After development | Scratch strength (g) |
| 1-1(Control) | — | | 0.42 | 0.45 | 0.43 | 15 |
| 1-2(Inv.) | I-1(20) | None | 0.12 | 0.11 | 0.12 | 55 |
| 1-3(") | I-3(20) | None | 0.11 | 0.12 | 0.14 | 58 |
| 1-4(") | I-7(20) | None | 0.11 | 0.12 | 0.13 | 60 |
| 1-5(") | I-8(20) | None | 0.13 | 0.12 | 0.13 | 57 |
| 1-6(") | I-10(20) | None | 0.11 | 0.11 | 0.12 | 55 |
| 1-7(") | II-1(20) | None | 0.12 | 0.11 | 0.12 | 56 |
| 1-8(") | II-3(20) | None | 0.11 | 0.12 | 0.13 | 58 |
| 1-9(") | II-5(20) | None | 0.12 | 0.12 | 0.12 | 60 |
| a-l(Comp.) | E-1(20) | None | 0.12 | 0.10 | 0.18 | 30 |
| a-2(") | E-2(20) | None | 0.11 | 0.12 | 0.27 | 43 |
| a-3(") | E-3(20) | Observed | 0.12 | 0.12 | 0.12 | 56 |
| a-4(") | E-5(20) | None | 0.12 | 0.11 | 0.22 | 47 |
| a-5(") | E-6(20) | Observed | 0.12 | 0.12 | 0.13 | 55 |
| a-6(") | E-10(20) | None | 0.12 | 0.13 | 0.23 | 43 |

Comparative Slip Agent Compound

Polydimethyl siloxane (M.W.=10,000) (E-1)

$C_{18}H_{37}OSO_3Na$ (E-2)

$C_{15}H_{31}COO(n^-)C_{40}H_{81}$ (E-3)

$C_{18}H_{37}OCO(CH_2)_{18}COOC_{18}H_{37}$ (E-4)

$C_{22}H_{45}O(CH_2CH_2O)_{15}H$ (E-5)

$C_{25}H_{51}O(CH_2CH_2O)_2H$ (E-6)

$C_{20}H_{41}O(CH_2CH_2O)_{45}H$ (E-7)

$C_{18}H_{37}O\underset{\underset{O}{\|}}{C}CH_2CH_2O(CH_2CH_2O)_{25}CH_2CH_2\underset{\underset{O}{\|}}{C}OC_{18}H_{37}$ (E-8)

$C_{25}H_{51}O\underset{\underset{O}{\|}}{C}CH_2CH_2\underset{\underset{O}{\|}}{C}O(CH_2CH_2O)_3\underset{\underset{O}{\|}}{C}CH_2CH_2\underset{\underset{O}{\|}}{C}OC_{25}H_{51}$ (E-9)

$C_{20}H_{41}O\underset{\underset{O}{\|}}{C}CH_2CH_2O(CH_2CH_2O)_{50}CH_2CH_2\underset{\underset{O}{\|}}{C}OC_{20}H_{41}$ (E-10)

1-2) Preparation of Photographic Light-Sensitive Material

The support thus prepared was subjected to discharge treatment on the side opposite to the backing layer, and then coated with various layers having the following compositions to prepare a multi-layer color photographic light-sensitive material.

(Composition of Photographic Layer)

Onto the foregoing support was coated a multi-layer color photographic layer in the same manner as the photographic layer of Example 1 in JP-A-2-93641.

(Processing of Specimen)

The specimen thus obtained was then cut into strips adapted for the current 35 mm width 135-format 24-frame film.

The development of the specimen was effected as follows:

| | |
|---|---|
| Color development | 3 min. 15 sec. |
| Bleaching | 6 min. 30 sec. |
| Rinse | 2 min. 10 sec. |
| Fixing | 4 min. 20 sec. |
| Rinse | 3 min. 15 sec. |
| Stabilization | 1 min. 05 sec. |

The processing solutions used at the various steps had the following compositions:

| | |
|---|---|
| Color Developer | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 g |
| Hydroxylamine sulfate | 2.4 g |
| 4-(N-ethyl-N-β-hydroxyethylamino)-2-methylaniline sulfate | 4.5 g |
| Water to make | 1.0 l |
| pH | 10.0 |
| Bleaching Solution | |
| Ammonium ethylenediaminetetraacetato ferrate | 100.0 g |
| Disodium ethylenediaminetetraacetate | 10.0 g |
| Ammonium bromide | 150.0 g |
| Ammonium nitrate | 10.0 g |
| Water to make | 1.0 l |
| pH | 6.0 |
| Fixing Solution | |
| Disodium ethylenediaminetetraacetate | 1.0 g |
| Sodium sulfite | 4.0 g |
| 70% Aq. ammonium sulfate soln. | 175.0 ml |
| Sodium bisulfite | 4.6 g |
| Water to make | 1.0 l |
| pH | 6.6 |

-continued

| | |
|---|---|
| Stabilizing Solution | |
| 40% Formalin | 2.0 ml |
| Polyoxyethylene-p-monononylphenyl ether (average polymerization degree: 10) | 0.3 g |
| Water to make | 1.0 l |

1-3) Evaluation of Properties

These specimens were evaluated as follows:

Evaluation of Slip Properties (1) Measurement of Static Friction Coefficient

The specimen was moisture-conditioned at a temperature of 25° C. and a relative humidity of 60% for 2 hours, and then measured for static friction coefficient by means of HEIDON-10 static friction coefficient meter with a 5-mmϕ stainless steel ball. The smaller the measurement is, the better are the slip properties.

(2) Measurement of Kinematic Friction Coefficient The specimen was moisture-conditioned at a temperature of 25° C. and a relative humidity of 60% for 2 hours, and then measured for kinematic friction coefficient by means of HEIDON-14 kinematic friction coefficient meter with a 5-mmϕ stainless steel ball under a load of 100 g at a friction velocity of 60 cm/min. The smaller the measurement is, the better are the slip properties.

(3) Evaluation of Scratch Resistance

The specimen was moisture-conditioned at a temperature of 25° C. and a relative humidity of 60% for 2 hours. Before development, the specimen thus conditioned was scratched on the back face (the side on which the photographic emulsion was not coated) with a diamond stylus having a 0.025 mmR tip under a continuous load at a rate of 60 cm/min.

The specimen thus scratched was put on a Schaukasten (film viewer). The transmission at which scratch can be first observed was defined as scratch resistance. The more this value is, the better is the scratch resistance.

1-4) Results

The results of the evaluation of the specimens of Examples 1-1 to 1-9 and Comparative Examples a-1 to a-6 are set forth in Table 1. The slip agents according to the present invention were excellent in all of slip agent solubility and slip properties and scratch resistance before and after processing.

On the other hand, Comparative Specimens a-1 to a-3, which comprised conventional slip agents, were disadvantageous in that they exhibit a poor scratch resistance, exhibit worsened slip properties after processing and cause crystallization in the coating solution. Further, Specimen a-1 repelled the emulsion during coating. Specimen a-4, which comprised a slip agent having a short alkyl chain, and Specimen a-6, which comprised a slip agent having a large nonionic moiety, exhibited a worsened scratch resistance and worsened slip properties after processing. Moreover, Specimen a-5, which comprised a slip agent having a short nonionic moiety, showed precipitation of the slip agent in the coating solution.

Accordingly, the use of slip agents according to the present invention, which exhibit a good solubility in the coating solution and cause no problems due to the transfer to the undercoating layer, can provide a photographic light-sensitive material which exhibits good slip properties and scratch resistance before and after processing.

EXAMPLE 2

2-1) Dispersion of Slip Agent

The slip agent set forth in Table 2 was added to cyclohexanone in the following formulations, and then heated to a temperature of 95° C. to make a solution.

(Formulations of Slip Agent Dispersion)

| | |
|---|---|
| Slip agent set forth in Table 2 | 1 part by weight |
| Cyclohexanone | 9 parts by weight |
| (Heated to 95° C. for dissolution) | |

The solution thus obtained was added to 10 parts by weight of cyclohexanone at room temperature with stirring for precipitation to prepare a slip agent dispersion.

2-2) Evaluation of Slip Agent Dispersion (Evaluation of Grain Diameter of Dispersed Grains)

The grain diameter of the dispersed grains was measured by Type N4 submicron grain analyzer available from COULTER Co. For the measurement, the dispersion was properly diluted with cyclohexanone to obtain a desired measurement concentration.

(Evaluation of Sedimentation Stability of Dispersion)

For the evaluation of the sedimentation stability of the foregoing lubricant dispersion, it was used to dilute the following slip layer coating solution. In the criterion, "X" indicates the condition under which sedimentation occurs within 10 minutes, "Δ" indicates the condition under which sedimentation occurs after 10 minutes to 1 hour, and "O" indicates the condition under which sedimentation occurs after more than 1 hour.

2-2 Preparation of Support

Onto a cellulose acetate film (support) was coated the following antistatic layer coating composition B in an amount of 30 ml/m$^2$. The material was then dried at a temperature of 70° C. for 3 minutes to form an antistatic layer.

| Antistatic Layer Coating Composition B | |
|---|---|
| Cationic latex | 2.7 g |
| 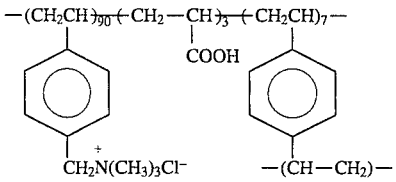 | |
| Diacetyl cellulose | 4.0 g |
| Methanol | 400 ml |
| Acetone | 600 ml |

Onto the foregoing antistatic layer was coated the following slip layer coating composition B in an amount of 20 ml/m$^2$. The material was then dried at a temperature of 100° C. for 3 minutes to form a slip layer.

| Slip Layer Coating Composition B | |
|---|---|
| Acetone | 600 ml |
| Cyclohexanone | 360 ml |
| Slip Agent Dispersion Mentioned Above | 40 g |

COMPARATIVE EXAMPLE b

The preparation of comparative dispersions, the evaluation of dispersions and the preparation of supports were conducted in the same manner as the foregoing example except that the foregoing inventive slip agents were replaced by the comparative slip agents set forth in Table 2.

TABLE 2

| Specimen No. | Type of slip agent (Solid content mg/m$^2$) | Slip agent dispersibility: Grain diameter (μm) | Slip agent dispersibility: Dispersion stability | Slip properties: Static friction coefficient | Slip properties: Kinematic friction coefficient: Before development | Slip properties: Kinematic friction coefficient: After development | Slip properties: Scratch resistance (g) | Slip properties: Surface condition |
|---|---|---|---|---|---|---|---|---|
| 2-1 (Control) | — | | | 0.42 | 0.45 | 0.43 | 15 | O |
| 2-2 (Invention) | I-2 (40) | 0.48 | O | 0.12 | 0.11 | 0.12 | 57 | O |
| 2-3 (") | I-3 (40) | 0.55 | O | 0.11 | 0.12 | 0.14 | 52 | O |
| 2-4 (") | I-4 (40) | 0.30 | O | 0.11 | 0.12 | 0.13 | 60 | O |
| 2-5 (") | I-6 (40) | 0.59 | O | 0.13 | 0.12 | 0.13 | 57 | O |
| 2-6 (") | I-9 (40) | 0.63 | O | 0.11 | 0.11 | 0.12 | 55 | O |
| 2-7 (") | I-12 (40) | 0.42 | O | 0.12 | 0.11 | 0.12 | 56 | O |
| 2-8 (") | II-1 (40) | 1.4 | O | 0.11 | 0.12 | 0.13 | 58 | Δ |
| 2-9 (") | II-3 (40) | 1.2 | O | 0.12 | 0.12 | 0.12 | 60 | Δ |
| 2-10 (") | II-6 (40) | 0.92 | O | 0.12 | 0.10 | 0.15 | 57 | O |
| b-1 (Comp.) | E-3 (40) | >3.0 | X | 0.14 | 0.13 | 0.13 | 43 | X |
| b-2 (") | E-4 (40) | >3.0 | X | 0.13 | 0.13 | 0.12 | 37 | X |
| b-3 (") | E-7 (40) | 0.85 | O | 0.13 | 0.13 | 0.20 | 43 | O |
| b-4 (") | E-8 (40) | 0.95 | O | 0.11 | 0.12 | 0.19 | 42 | O |
| b-5 (") | E-9 (40) | >3.0 | Δ | 0.12 | 0.13 | 0.12 | 49 | X |

2-4) Preparation of Photographic Light-Sensitive Material

The support having a back face thus obtained was coated with a photographic layer and worked into a photographic light-sensitive material specimen in the same manner as in Example 1.

Development was conducted in the same manner as in Example 1. The specimens thus obtained were evaluated in the same manner as in Example 1. The results are set forth in Table 2.

Further, the condition of the coated surface of the specimens were evaluated. In the criterion, O indicates the condition which is little different from that before the coating of slip agent, Δ indicates the condition under which seeding and haze are observed but little appreciable, and X indicates the condition under which seeding and haze are considerably appreciable.

2-5) Results

The results of the evaluation of the specimens of Examples 2-1 to 2-10 and Comparative Examples b-1 to b-5 are set forth in Table 2. In Examples 2-2 to 2-10, which employed the slip agents according to the present invention, the dispersed grain diameter was small enough and the dispersion stability was excellent. The coated specimens were excellent in both slip properties and scratch resistance before and after processing as well as in surface condition. Thus, these specimens were excellent in all respects.

On the other hand, Comparative Specimens b-1 and b-2, which comprised known slip agents, exhibited an extremely poor dispersion stability and a poor surface condition after coating. Further, Specimen b-3, which comprised a slip agent having a short alkyl chain, and Specimen b-4, which comprised a slip agent having a large nonionic moiety, exhibited a worsened scratch resistance and worsened slip properties after processing. Moreover, Specimen b-5, which comprised a slip agent having a short nonionic moiety, exhibited a poor dispersion stability and a poor surface condition after coating.

Accordingly, the use of slip agents according to the present invention can provide a photographic light-sensitive material having an excellent dispersion stability, good slip properties and scratch resistance before and after processing and a good surface condition.

EXAMPLE 3

3-1) Dispersion of Slip Agent

The slip agent set forth in Table 3 was added to the following solvent, and then heated to a temperature of 105° C. to make a solution in accordance with the following formulations.

(Formulations of Slip Agent Dispersion)

| | |
|---|---|
| Slip agent set forth in Table 3 | 1 part by weight |
| 1-Methoxy-2-propanol (Heated to 105° C. for dissolution) | 4 parts by weight |

The solution was poured in 15 parts by weight of 1-methoxy-2-propanol which had been ice-cooled with stirring for precipitation to prepare a slip agent dispersion.

3-2) Evaluation of Slip Agent Dispersion (Evaluation of Grain Diameter of Dispersed Grains)

The grain diameter of the dispersed grains was measured by Type N4 submicron grain analyzer available from COULTER Co. For the measurement, the dispersion was properly diluted with 1-methoxy-2-propanol to obtain a desired measurement concentration.

(Evaluation of Sedimentation Stability of Dispersion)

For the evaluation of the sedimentation stability of the foregoing slip agent dispersion, it was used to dilute the following slip layer coating solution. In the criterion, X indicates the condition under which sedimentation occurs within 5 minutes, Δ indicates the condition under which sedimentation occurs after 5 minutes to 1 hour, and O indicates the condition under which sedimentation occurs after more than 1 hour.

3-3) Preparation of Support 3

(Coating of Undercoating Layer)

A polyethylene terephthalate film (PET) was irradiated with ultraviolet rays on both sides thereof. Onto both sides of the support thus treated was coated an undercoating solution having the following composition in an amount of 10 ml/m$^2$. The material was dried at a temperature of 120° C. for 2 hours, and then wound. The irradiation with ultraviolet rays was effected under the conditions described in JP-B-45-3828.

| | |
|---|---|
| Gelatin | 1 part by weight |
| Water | 1 part by weight |
| Acetic acid | 1 part by weight |
| Methanol | 50 parts by weight |
| Ethylene dichloride | 50 parts by weight |
| p-Chlorophenol | 4 parts by weight |

The same PET film as used above was subjected to corona discharge treatment on both sides thereof. Onto both sides of the support thus treated was coated an undercoating layer having the following composition. For the corona discharge treatment, Type 6KVA solid state corona discharger available from Pillar Corp. was used. A 30-cm wide support was treated at a rate of 20 m/min. The object to be treated was treated at 0.375 kv·A·min/m$^2$ in accordance with reading of electric current and voltage. The discharge frequency was 9.6 KHz, and the gap clearance between the electrode and the dielectric roll was 1.6 mm.

| | |
|---|---|
| Gelatin | 3 g |
| Distilled water | 250 ml |
| Sodium α-sulfo-di-2-ethylhexylsuccinate | 0.05 g |
| Formaldehyde | 0.02 g |
| (Coating of Backing Layer) | |

The two supports which had been subjected to different surface treatments were each coated with a backing layer having the following composition on the side thereof opposite the undercoating layer to prepare specimens. The specimens which had been irradiated with ultraviolet rays are designated 3-1, 3-2, etc. On the other hand, the specimens which had been corona-discharged are designated 3'-1, 3'-2, etc. While the present invention will be further described with reference to the specimens which had been irradiated with ultraviolet rays, it should be appreciated that the specimens which had been corona-discharged were similarly processed.

(1) Preparation of Dispersion of Fine Grains of Electrically Conductive Substance (Tin Oxide-Antimony Oxide Composite Dispersion)

230 parts by weight of hydrous stannous chloride and 23 parts by weight of antimony trichloride were dissolved in 3,000 parts by weight of ethanol to make a homogeneous solution. To the solution was then added dropwise a 1 N aqueous sodium hydroxide solution until the solution exhibited a pH value of 3 to obtain a colloidal co-precipitate of stannous oxide and antimony oxide. The co-precipitate thus obtained was then allowed to stand at a temperature of 50° C. for 24 hours to obtain a reddish brown colloidal precipitate.

The reddish brown colloidal precipitate was then separated out by centrifugal separation. In order to remove excess ions, water was added to the precipitate, and then subjected to centrifugal separation so that it was rinsed. This procedure was repeated three times to remove excess ions.

200 parts by weight of the colloidal precipitate were re-dispersed in 1,500 parts by weight of water. The dispersion was then sprayed into a kiln which had been heated to a temperature of 500° C. to obtain bluish fine grains of stannous oxide-antimony oxide composite having an average grain diameter of 0.15 μm. The grain powder thus obtained exhibited a resistivity of 25 Ω·cm.

A mixture of 40 parts by weight of the grains and 60 parts by weight of water was prepared with a pH value of 7.0. The mixture was then subjected to coarse dispersion by means of an agitator. The solution was then subjected to dispersion by means of a horizontal sandmill (Dinomill, available from Willy A. Backfen AG) until the residence time reached 30 minutes.

(2) Coating of Antistatic Layer

The following composition (A) was coated in an amount such that the dry thickness reached 0.3 μm. The material was dried at a temperature of 130° C. for 30 seconds.

(Antistatic Layer Coating Solution (A))

| | |
|---|---|
| Fine dispersion of electrically conductive substance ($SnO_2/Sb_2O_3$; 0.05 μm) | 10 parts by weight |
| Gelatin | 1 part by weight |
| Water | 27 parts by weight |
| Methanol | 60 parts by weight |
| Resorcinol | 2 parts by weight |
| Polyoxyethylene nonyl phenyl ether (polymerization degree: 10) | 0.01 parts by weight |

(3) Coating of Slip Layer Onto the foregoing antistatic layer was coated the following slip layer coating composition C in an amount of 10 ml/m$^2$. The material was then dried at a temperature of 110° C. for 3 minutes to form a surface layer.

(Slip Layer Coating Composition C)

| | |
|---|---|
| Cellulose acetate | 1 part by weight |
| Acetone | 65 parts by weight |
| Methanol | 5 parts by weight |
| Dichloromethylene | 10 parts by weight |
| p-Chlorophenol | 4 parts by weight |
| Slip agent according to the present invention or in Comparative Example c | 15 parts by weight |

COMPARATIVE EXAMPLE c

The preparation of comparative dispersions, the evaluation of dispersions and the preparation of supports were conducted in the same manner as the foregoing example except that the foregoing inventive slip agents were replaced by the comparative slip agents set forth in Table 3.

3-4) Preparation of Support 4

Polyethylene naphthalate (PEN) chips were melt-extruded into a sheet. The sheet was then longitudinally oriented by 3.4 times and crosswise oriented by 4 times to prepare a biaxially oriented polyester film having a thickness of 80 μm. In this process, the extrusion temperature was 300° C., the longitudinal orientation temperature was 140° C., and the crosswise orientation temperature was 130° C. The film was thermally fixed at a temperature of 250° C. for 6 seconds. During the longitudinal orientation, the film was heated on one side thereof so that a temperature difference of 20° C. was made between one side and the other side thereof. This film was wound on a stainless steel core, and then heat-treated at a temperature of 110° C. for 72 hours to prepare a support.

This support was then subjected to surface treatment and subsequent coating of the undercoating layer, the antistatic layer and the slip layer in the same manner as the support 3 except that the drying temperature at which the surface treatment and coating of the undercoating layer and the antistatic layer are effected was not higher than 110° C. and the slip layer set forth in Table 3 was coated thereon. Thus, Specimens 4-1 to 4-4 were prepared.

COMPARATIVE EXAMPLE d

Comparative Specimen d was prepared in the same manner as above except that the PEN film was not subjected to heat treatment at a temperature of 110° C. for 72 hours.

TABLE 3

| | | | | Slip properties | | | | |
|---|---|---|---|---|---|---|---|---|
| | Type of lubricant | Lubricant dispersibility | | | Kinematic friction coefficient | | Scratch | |
| Specimen No. | (Solid content mg/m$^2$) | Grain diameter (μm) | Dispersion stability | Static friction coefficient | Before development | After development | resistance (g) | Surface condition |
| 3-1 (Control) | — | | | 0.42 | 0.45 | 0.43 | 15 | ○ |
| 3-2 (Inv.) | I-2 (75) | 0.48 | ○ | 0.12 | 0.11 | 0.12 | 65 | ○ |
| 3-3 (Inv.) | I-4 (75) | 0.30 | ○ | 0.11 | 0.12 | 0.14 | 68 | ○ |
| 3-4 (Inv.) | I-5 (75) | 0.16 | ○ | 0.11 | 0.12 | 0.13 | 62 | ○ |
| 3-5 (Inv.) | I-9 (75) | 0.88 | ○ | 0.13 | 0.12 | 0.12 | 66 | ○ |
| 3-6 (Inv.) | II-2 (75) | 0.92 | ○ | 0.12 | 0.11 | 0.12 | 63 | ○ |
| 3-7 (Inv.) | II-4 (75) | 1.2 | ○ | 0.11 | 0.12 | 0.13 | 69 | Δ |
| 4-1 (Inv.) | I-2 (75) | 0.48 | ○ | 0.12 | 0.11 | 0.12 | 60 | ○ |
| 4-2 (Inv.) | I-8 (75) | 0.55 | ○ | 0.13 | 0.12 | 0.13 | 62 | ○ |
| 4-3 (Inv.) | I-11 (75) | 0.62 | ○ | 0.11 | 0.11 | 0.12 | 63 | ○ |
| 4-4 (Inv.) | II-5 (75) | 1.1 | ○ | 0.12 | 0.12 | 0.12 | 61 | Δ |

TABLE 3-continued

| Specimen No. | Type of lubricant (Solid content mg/m²) | Lubricant dispersibility: Grain diameter (μm) | Lubricant dispersibility: Dispersion stability | Slip properties: Static friction coefficient | Slip properties: Kinematic friction coefficient: Before development | Slip properties: Kinematic friction coefficient: After development | Scratch resistance (g) | Surface condition |
|---|---|---|---|---|---|---|---|---|
| c-1 (Comp.) | E-3 (75) | >3.0 | X | 0.12 | 0.10 | 0.15 | 30 | X |
| c-2 (Comp.) | E-4 (75) | >3.0 | X | 0.11 | 0.12 | 0.27 | 43 | X |
| c-3 (Comp.) | E-5 (75) | 0.25 | O | 0.12 | 0.12 | 0.20 | 35 | O |
| c-4 (Comp.) | E-6 (75) | >3.0 | X | 0.18 | 0.18 | 0.25 | 20 | X |
| d-1 (Comp.) | I-2 (75) | 0.48 | O | 0.12 | 0.12 | 0.20 | 59 | O |
| d-2 (Comp.) | I-5 (75) | 0.16 | O | 0.11 | 0.12 | 0.12 | 60 | O |

3-5) Preparation of Photographic Light-Sensitive Material

The supports 3 and 4 and the comparative supports c and d having a back face thus obtained were coated with a photographic layer and worked into a photographic light-sensitive material specimen in the same manner as in Example 1.

Development was conducted in the same manner as in Example 1. The specimens thus obtained were evaluated in the same manner as in Example 1. The results are set forth in Table 3.

3-6) Results

The results of the evaluation of the foregoing specimens are set forth in Table 3. In Specimens 3-2 to 3-7 and 4-1 to 4-4, which employed the slip agent according to the present invention, the dispersed grain diameter was small enough and the dispersion stability was excellent. The coated specimens were excellent in both slip properties and scratch resistance before and after processing as well as in surface condition. Thus, these specimens were excellent in all respects.

On the other hand, Comparative Specimens c-1 and c-2, which comprised known slip agents, exhibited an extremely poor dispersion stability and a poor surface condition after coating. Further, Specimen c-3, which comprised a slip agent having a short alkyl chain, exhibited a worsened scratch resistance and worsened slip properties after processing. Moreover, Specimen c-4, which comprised a slip agent having a short nonionic moiety, exhibited a poor dispersion stability and a poor surface condition after coating.

The foregoing specimens were heat-treated in a cartridge at a temperature of 80° C. for 2 hours. These specimens were then subjected to development in an automatic developing machine. As a result, Specimens 3-2 to 3-7, which comprised PET as a support, and Specimens d-1 and d-2, which comprised untreated PEN as a support, were liable to curling. Thus, these specimens broke at its tailing end during conveyance in the automatic developing machine or showed uneven development at its tailing end. On the other hand, Specimens 4-1 to 4-4, which comprised heat-treated PEN as a support, were insusceptible to curling and thus caused no troubles during development.

Further, the specimens prepared by different surface treatments before undercoating showed similar results.

The above results show that the use of slip agents according to the present invention can provide a photographic light-sensitive material having a good dispersion stability, sufficient slip properties and scratch resistance and a good surface condition even in combination with a binder, and good slip properties before and after processing. Further, the use of heat-treated PEN film as a support can provide a specimen which is insusceptible to curling.

4. Evaluation of Antistatic Effect

Among the foregoing specimens, those set forth in Table 4 were evaluated for antistatic effect. For the evaluation of electric conductivity, the film specimen was coated with an electrically conductive paste on a 1-cm wide film edge to which a resistivity meter was connected for the measurement of the electric resistance thereof. The measurement was conducted at a temperature of 25° C. and 10% RH.

These specimens were also evaluated for dust attractivity at 25° C. and 10% RH. In the criterion, 0 indicates the condition under which little or no dust is attracted, and X indicates the condition under which dust can be easily attracted.

COMPARATIVE EXAMPLE e

Comparative Specimen e-1 was prepared in the same manner as Specimen 1-2 in Example 1 except that the antistatic layer coating composition was not coated.

Further, Comparative Specimen e-2 was prepared in the same manner as Specimen 3-2 in Example 3 except that the dispersion of fine grains of electrically conductive substance was not incorporated in the antistatic layer coating solution.

4-3) Results

The results of the evaluation of antistatic effect are set forth in Table 4. Table 4 shows that Specimens 1-2 and 2-2, which comprised an ionic polymer antistatic agent, and Specimens 3-2 and 4-1, which comprised an antistatic agent made of electrically conductive metal oxide, exhibited a low electric conductivity before processing and thus attracted no dust. Further, Specimens 3-2 and 4-1 exhibited a low electric conductivity even after development and thus attracted no dust. On the other hand, Comparative Specimens e-1 and e-2, which were free of antistatic agent, exhibited a high electric conductivity and thus easily attracted dust.

Thus, the combination of a specimen comprising a slip agent according to the present invention with an antistatic agent made of an ionic polymer and/or an electrically conductive metal oxide can provide a photographic light-sensitive material which is more insusceptible to dust attraction. In particular, the combination with a metallic oxide can provide an excellent photographic light-sensitive material which is insusceptible to dust attraction.

TABLE 4

| Specimen No. | Slip agent type (solid content mg/m²) | Before development | | After development | |
|---|---|---|---|---|---|
| | | Electric conductivity (Ω) | Dust attractivity | Electric conductivity | Dust attractivity |
| 1-2 (Inv. ) | I-1 (20) | $2 \times 10^{10}$ | ○ | $4 \times 10^{13}$ | X |
| 2-2 (Inv.) | I-2 (40) | $3 \times 10^{10}$ | ○ | $6 \times 10^{12}$ | X |
| 3-2 (Inv.) | I-2 (75) | $8 \times 10^{9}$ | ○ | $9 \times 10^{9}$ | ○ |
| 4-1 (Inv.) | I-2 (75) | $9 \times 10^{9}$ | ○ | $1 \times 10^{10}$ | ○ |
| e-1 (Comp.) | I-1 (20) | $4 \times 10^{16}$ | X | $8 \times 10^{16}$ | X |
| e-2 (Comp.) | I-2 (75) | $6 \times 10^{17}$ | X | $2 \times 10^{17}$ | X |

5. Change of Slip Properties

Specimens were prepared in the same manner as Specimen 3-2 except that the solid content of slip agents were altered as set forth in Table 5, respectively. These specimens were subjected to development and printing in an automatic developing machine. The resulting damage was then evaluated.

For the evaluation of slip properties, the slipperiness between the emulsion face and the back face was measured. The measurement of slipperiness was conducted under almost the same conditions as kinematic friction coefficient. As a measurement stylus, there was used a 1-cm square surface of specimen emulsion. The slipperiness of the back face was conducted under a load of 100 g at a friction velocity of 60 cm/min. As a result, almost the same results as that of stainless steel ball were obtained.

As a result, the specimens having a slipperiness of more than 0.25 after development showed printing damage. On the other hand, the specimens having a slipperiness of not more than 0.25 after development were insusceptible to damage.

TABLE 5

| Specimen No. | Lubricant type (solid content mg/m²) | Kinematic friction coefficient (with stainless steel ball) | | Damage after printing |
|---|---|---|---|---|
| | | Before development | After development | |
| 3-2 (Inv.) | I-2 (75) | 0.11 | 0.12 | ○ |
| 3-2a (Inv.) | I-2 (50) | 0.12 | 0.18 | ○ |
| 3-2b (Inv.) | I-2 (20) | 0.15 | 0.23 | Δ |
| 3-2c (Comp.) | I-2 (10) | 0.19 | 0.28 | X |
| 3-2d (Comp.) | I-2 (0) | 0.44 | 0.40 | XX |

As mentioned above, the present invention provides a photographic light-sensitive material having a surface layer which exhibits little bleeding during coating or with time and little deterioration of slip properties after development or with time under various working conditions without causing troubles such as unevenness during coating and poor adhesion. The present invention also provides improvements in the stability of a dispersion containing a slip agent, thereby obtaining a photographic light-sensitive material having uniformly coated surface layers.

Further, the present invention provides a photographic light-sensitive material having a slip layer which exhibits sufficient slip properties and scratch resistance and a good surface condition even in combination with a binder.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer and a surface layer, wherein said silver halide photographic material contains at least one compound represented by the following general formula (1) or (2):

$$R_1XAD \quad (1)$$
$$R_2YBZR_3 \quad (2)$$

wherein $R_1$ represents a $C_{30-70}$ alkyl group; $R_2$ and $R_3$ each represent a $C_{25-70}$ alkyl group; X and Y each represent a divalent bridging group selected from the group consisting of —C(O)O—, —OCO—, —C(O)NR'—, —NR'CO—, —$SO_2$NR'—, —NR'$SO_2$—, —O—, —S—, —NR'—, —OCOR"COO—, and —OCOR'"O—, wherein R' represents a hydrogen atom or an alkyl group having not more than 8 carbon atoms, R" represents a bond or a $C_{1-8}$ hydrocarbon group, and R'" represents a $C_{1-8}$ hydrocarbon group; Z represents a divalent bridging group selected from the group consisting of —C(O)—, —C(O)R"COO—, and —C(O)R'"O—, wherein R" and R'" are the same as defined above; A and B each represent a unit selected from the group consisting of $—(CH_2CH_2O)_a—$, $—(CH_2CH(OH)CH_2O)_b—$, $—((CH_2)_cCH(R)CH_2O)_d—$, and $—(CH_2CH_2O)_e—(CH_2CH(OH)CH_2O)_f—((CH_2)_cCH(R)CH_2O)_g—$, wherein c represents an integer 1 to 3, R represents H, $CH_3$ or a phenyl group, a represents an integer 5 to 40, b and d each represent an integer 5 to 30, e represents an integer 0 to 40, and f and g each represent an integer 0 to 30; and D represents a hydrogen atom or $C_{1-8}$ alkyl group.

2. The silver halide photographic material according to claim 1, wherein said compound represented by the general formula (1) or (2) is incorporated in said surface layer in the form of a dispersion in a coating solution.

3. The silver halide photographic material according to claim 1, wherein said compound represented by the general formula (1) or (2) is incorporated in said surface layer together with a binder.

4. The silver halide photographic material according to claim 2, wherein said compound represented by the general formula (1) or (2) is incorporated in said surface layer together with a binder.

5. The silver halide photographic material according to claim 1, wherein said compound represented by the general formula (1) or (2) is incorporated in said surface layer, wherein said surface layer is a backing layer and said backing layer exhibits a kinematic coefficient of friction of not more than 0.25 before and after development.

6. The silver halide photographic material according to claim 2, wherein said compound represented by the general formula (1) or (2) is incorporated in said surface layer, wherein said surface layer is a backing layer and said backing layer exhibits a kinematic coefficient of friction of not more than 0.25 before and after development.

7. The silver halide photographic material according to any one of claims 1 to 6, wherein an electrically conductive metal oxide and/or ionic polymer having an electrical resistance of not more than $10^{12}$ Ω at 25° C. and 10% RH is incorporated as an antistatic agent in said surface layer, wherein said surface layer is a backing layer.

8. The silver halide photographic material according to claim 7, wherein said antistatic agent is an electrically conductive metal oxide.

9. The silver halide photographic material according to any one of claims 1 to 6 or 8, wherein said support is a polyester support comprising naphthalene dicarboxylic acid as a main component, wherein said naphthalene dicarboxylic acid is 50 mol % or more 2,6-naphthalene dicarboxylic acid, and said polyester support has been subjected to heat treatment at a temperature of not lower than 50° C. to not higher than the glass transition point thereof for 0.1 to 1,500 hours between after the film formation and before the coating of a photographic layer.

10. The silver halide photographic material according to claim 1, wherein said surface layer contains at least one compound of general formula (1) or (2) and is an outermost layer on an emulsion layer or a backing layer.

11. The silver halide photographic material according to claim 10, wherein said surface layer is a backing layer.

12. The silver halide photographic material according to claim 1, wherein $R_1$ represents a $C_{30-50}$ alkyl group.

13. The silver halide photographic material according to claim 1, wherein said surface layer comprising a slip agent, wherein the amount of said slip agent is 0.001 to 0.5 g/m$^2$.

14. The silver halide photographic material according to claim 1, wherein said surface layer comprising a slip agent, wherein the amount of said slip agent is 0.002 to 0.3 g/m$^2$.

* * * * *